US007905583B2

(12) United States Patent
Inoue

(10) Patent No.: US 7,905,583 B2
(45) Date of Patent: Mar. 15, 2011

(54) INK SUPPLY SYSTEM

(75) Inventor: Kyoichi Inoue, Akishima (JP)

(73) Assignee: Olympus Corporation, Tokyo (JP)

( * ) Notice: Subject to any disclaimer, the term of this patent is extended or adjusted under 35 U.S.C. 154(b) by 1273 days.

(21) Appl. No.: 11/489,160

(22) Filed: Jul. 19, 2006

(65) Prior Publication Data

US 2007/0024682 A1 Feb. 1, 2007

(30) Foreign Application Priority Data

Jul. 29, 2005 (JP) ..... 2005-220411

(51) Int. Cl.
*B41J 2/17* (2006.01)

(52) U.S. Cl. ..... 347/84

(58) Field of Classification Search ..... 347/84, 347/85, 87

See application file for complete search history.

(56) References Cited

U.S. PATENT DOCUMENTS 6,048,047 A * 4/2000 Terasawa et al. ..... 347/30
6,773,099 B2 8/2004 Inoue et al.
7,004,575 B2 * 2/2006 Inoue et al. ..... 347/86

FOREIGN PATENT DOCUMENTS

JP 2738777 B2 1/1998
JP 2003-251826 A 9/2003

* cited by examiner

*Primary Examiner* — K. Feggins
(74) *Attorney, Agent, or Firm* — Holtz, Holtz, Goodman & Chick, PC

(57) ABSTRACT

The present invention comprises at least a reservoir tank which stores an ink supplied from an ink supply section, and an ink chamber which distributes and supplies the ink supplied from the reservoir tank to each recording head in a recording head group, wherein the reservoir tank maintains a predetermined negative pressure state with respect to the ink in a plurality of ink nozzles of each recording head through the ink chamber, and the ink chamber supplies the ink with an uniformed pressure loss in ink supply paths to each recording head in the recording head group.

17 Claims, 7 Drawing Sheets

PRIOR ART

INK SUPPLY SYSTEM

CROSS-REFERENCE TO RELATED APPLICATIONS

This application is based upon and claims the benefit of priority from prior Japanese Patent Application No. 2005-220411, filed Jul. 29, 2005, the entire contents of which are incorporated herein by reference.

BACKGROUND OF THE INVENTION

1. Field of the Invention

The present invention relates to an ink supply system and an image recording apparatus including the ink supply system which stably supplies the ink fed from an ink supply section to a plurality of ink nozzles in recording heads.

2. Description of the Related Art

In recent years, an image recording apparatus which easily, inexpensively and rapidly records an image on a recording medium has a recording head group (a linear ink head module) mounted therein. The recording head group has a structure in which a plurality of recoding heads are arranged in rows on a fixed carriage. An image recording apparatus which records an image with respect to a recording medium to be carried in this manner has been put into practical use.

In general, this recording head group is arranged to be greater than a width of a recording medium along a direction (a width direction of the recording medium) perpendicular to a carriage direction of the recording medium, and a plurality of ink nozzles arranged in each recording head along the width direction of the recording medium. The plurality of ink nozzles form a nozzle line. In the case of an image recording apparatus which performs color recording, a plurality of nozzle lines corresponding to this color recording must be configured.

In order to improve and stabilize a quality of an image to be recorded, a pressure loss of the recording head group with respect to an ink path must be uniformed when supplying the ink to respective recording heads for the same color.

As a prior art of a recording apparatus which uniforms such a pressure loss of an ink path, e.g., Jpn. Pat. Appln. KOKAI Publication No. 2003-251826 is disclosed. FIG. 9 shows a recording apparatus disclosed in Jpn. Pat. Appln. KOKAI Publication No. 2003-251826.

In this recording apparatus is provided a liquid storing container 72 (including a negative pressure stabilizing mechanism) having a movable member 71 which can at least partially transform in accordance with an amount of ink, a spring member 73 which exercises a spreading force with respect to the movable member 71 to generate a necessary negative pressure (a pressure loss), and communication openings 74 through which air is introduced into the inside in accordance with an increasing negative pressure.

This recording apparatus introduces air into the liquid storing container 72 from the communication openings 74 in accordance with an amount of ink in the liquid storing container 72. A negative pressure in the liquid storing container 72 is stabilized by the introduced air and the spring member 73. Therefore, a pressure loss of an ink path is uniformed. As a result, the recording apparatus stably supplies the ink.

Further, Published Japanese Patent No. 2738777 also discloses a similar inkjet recording apparatus. In this inkjet recording apparatus are provided each recording head provided in accordance with ink of each of a plurality of colors, an ink supply source which supplies the ink to each recording head, and each ink supply tube which couples each recording head with the ink supply source.

A length of the ink supply tube (an ink supply path) is configured to be shorter as the ink supply tube is compatible with ink which is apt to be hardened and fixed.

BRIEF SUMMARY OF THE INVENTION

An ink supply system to which an ink of a predetermined color is supplied from an ink supply section according to the present invention comprises at least one of a recording head group in which there are provided a plurality of recording heads each having a plurality ink nozzles through which the ink of the predetermined color is discharged to a recording medium to be carried; a reservoir tank which stores the ink of the predetermined color supplied from the ink supply section; and an ink chamber which distributes and supplies the ink of the predetermined color fed from the reservoir tank to the recording heads provided in the recording head group, wherein the inside of the ink chamber is maintained in a predetermined negative pressure state.

An image recording apparatus according to the present invention comprises an ink supply system which has at least one of a recording head group in which there are provided a plurality of recording heads each having a plurality ink nozzles through which the ink of a predetermined color is discharged to a recording medium to be carried, a reservoir tank which stores the ink of the predetermined color and an ink chamber which distributes and supplies the ink of the predetermined color supplied from the reservoir tank to the recording heads provided in the recording head group; an ink supply section which supplies the ink of the predetermined color to the reservoir tank include in the ink supply system; a conveying mechanism which is provided to opposed to the recording head group included in the ink supply system and carries the recording medium; a feeding system which stores the recording medium and feeds the medium to the conveying mechanism; an storing system which stores the recording medium having an image recorded by the recording head group; and a control section which controls the ink supply system, the ink supply section, the carriage mechanism, the feeding system and the storing system.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments according to the present invention will now be described hereinafter in detail with reference to the accompanying drawings.

An embodiment according to the present invention will be explained in conjunction with FIGS. 1 to 8.

Figure 1:
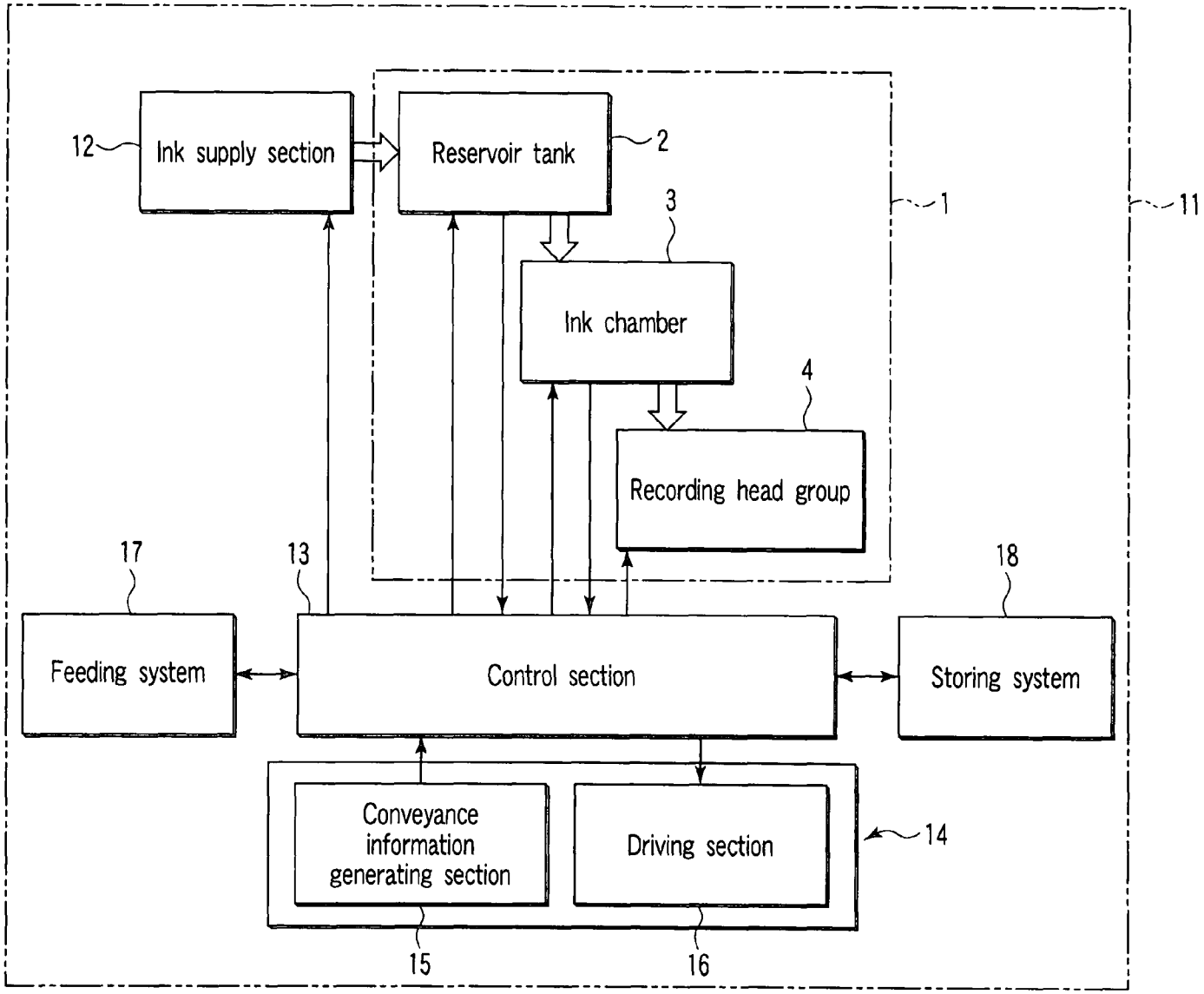
FIG. 1 is a conceptual block diagram showing a relationship between an ink supply system and an image recording apparatus including the ink supply system according to the present invention.

FIG. 1 is a conceptual block diagram showing a relationship between an ink supply system and an image recording apparatus including the ink supply system according to the present invention;

The image recording apparatus 11 shown in FIG. 1 is provided with at least a conveying mechanism 14 having a conveyance information generating section 15 and a driving section 16, a feeding system 17 which feeds a recording medium (not shown in FIG. 1) to the conveying mechanism 14, a storing system 18 which stores the recording medium having an image recorded thereon which has been ejected by the conveying mechanism 14, an ink supply section 12 which stores an ink of a predetermined color and supplies the ink of the predetermined color to a later-described ink supply system 1, and a control section 13. Further, the image recording apparatus 11 includes at least one of the ink supply system 1 which is characteristic of the present invention.

The control section 13 controls the ink supply system 1, the ink supply section 12, the conveying mechanism 14, the feeding system 17, and the storing system 18.

The ink supply system 1 is provided with at least a reservoir tank 2 which stores a predetermined amount of the ink of the predetermined color supplied from the ink supply section 12, an ink chamber 3 which stores a predetermined amount of the ink supplied from the reservoir tank 2 and distributes this ink to recording heads, and a recording head group 4 having a plurality of recording heads.

Each recording head in this recording head group 4 has a plurality of ink nozzles from which the ink is discharged to the recording medium to be carried.

A description will now be given as to an arrangement of the image recording apparatus 11 excluding the ink supply section 12, the control section 13 and a part of the ink supply system 1 with reference to FIG. 2.

In the feeding system 17 are provided a feeding tray 22, a pickup roller 23 and a resist roller pair 24.

The feeding tray 22 stores a plurality of the recording mediums 21.

The pickup roller 23 is provided above the feeding tray 22 picks up and carries the recording mediums 21 one by one.

The resist roller pair 24 temporarily comes into contact with the picked-up and carried recording medium 21 to correct oblique traveling of the recording medium 21, and holds and carries the recording medium 21 to the conveying mechanism 14 side after correction.

In the conveying mechanism 14 are provided three platen rollers 25, 26 and 27 which are distanced from each other at predetermined distances between, e.g., an upstream side and a downstream side of a carriage direction of the recording medium 21 and arranged substantially parallel. An endless belt 30 is wound around the platen rollers 25, 26 and 27 to allow its swiveling movement. As a result, the conveying mechanism 14 constitutes a belt conveyance mechanism.

For example, a rotary encoder which is the conveyance information generating section 15 is connected with a rotary shaft of the platen roller 25. For example, a motor which is the driving section 16 is connected with a rotary shaft of the platen roller 27.

Furthermore, rollers 28 and 29 are provided above the platen rollers 25 and 27 opposed to the rollers 25 and 27 across the endless belt 30, respectively. The rollers 28 and 29 prevent the recording medium 21 from being raised.

In the carriage direction of the recording medium 21, a sucking section 31 having suction fans 32 are provided between the platen roller 25 and the platen roller 27 provided in the inner side of the endless belt 30 along the carriage direction of the recording medium 21. The sucking section 31 sucks the carried recording medium 21 onto the endless belt 30 by using the suction fan 32.

The recording head group 4 has the plurality of recording heads. A nozzle line (a nozzle forming surface) 4*a* forming the plurality of ink nozzles is provided in each recording head to be opposed to, e.g., the endless belt 30 (a carried surface of the recording medium 21) of the conveying mechanism 14. The recording head group 4 is fixed in a carriage 33 to be opposed to an entire width of the recording medium 21 in a direction perpendicular to the carriage direction of the recording medium 21. (It is to be noted that FIG. 2 shows an example where the respective recording head groups K [black], C [cyan], M [magenta] and Y [yellow] are arranged at predetermined intervals from the upstream side toward the downstream side of the carriage direction of the recording medium 21.)

In the carriage direction of the recording medium 21, a roller pair 34 which carries the recording medium 21 having an image recorded thereon to a storing tray 35 is provided in the upstream side of the storing tray 35 in the storing system 18.

A first embodiment of the ink supply system according to the present invention will now be described with reference to FIGS. 1 and 3 to 5.

The ink supply section 12 which supplies the ink to the ink supply system 1 will be first explained. This ink supply section 12 supplies the ink to the ink supply system 1 which is characteristic of the present invention, and it is a constituent element different from the ink supply system 1.

Figure 3:
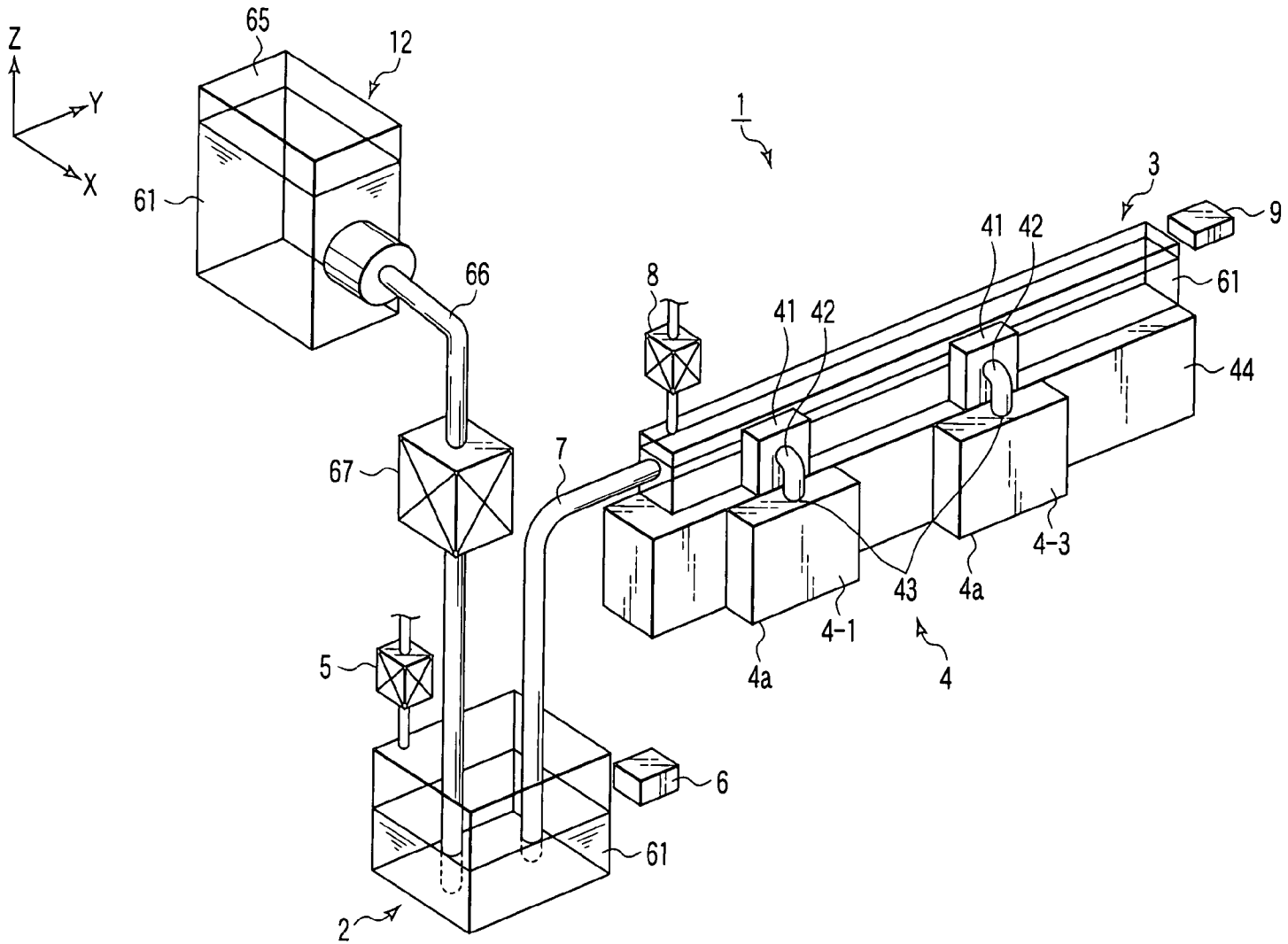
FIG. 3 is a perspective view showing a first embodiment of the ink supply system according to the present invention.
Figure 4:
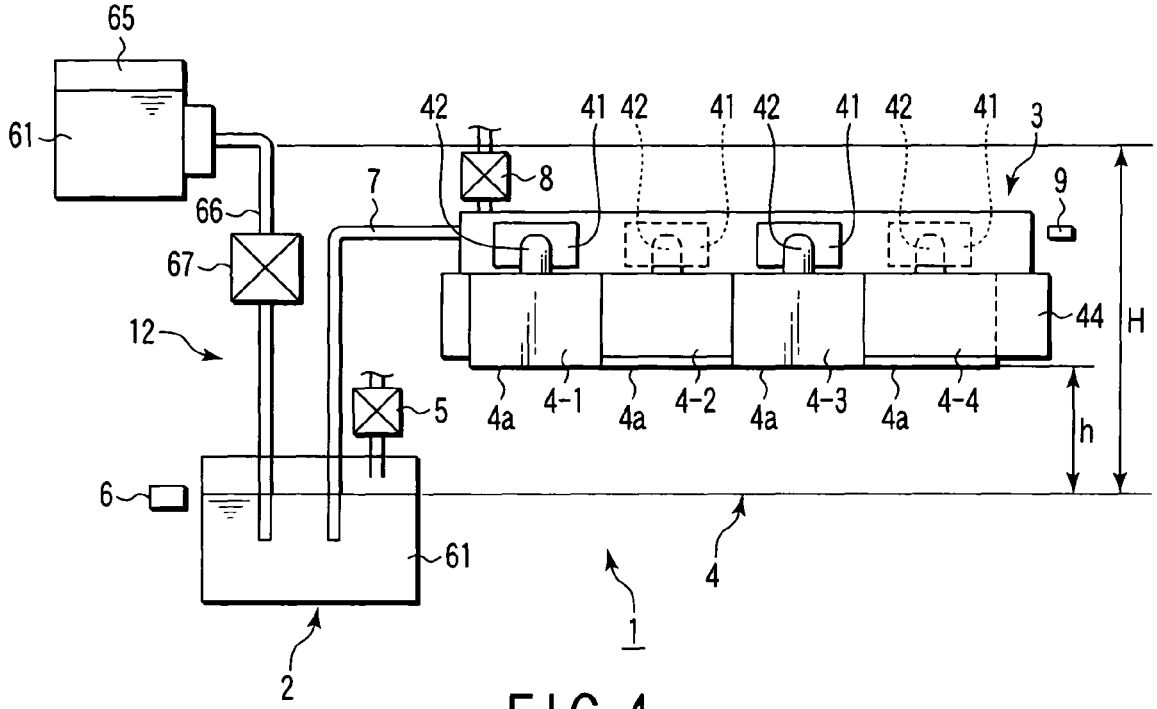
FIG. 4 is a front view showing the first embodiment of the ink supply system according to the present invention.

FIGS. 3 and 4 show the ink supply section 12 adopting a mode which utilizes a gravitational fall to supply ink. It is assumed that the fall at this time is a distance H.

In this ink supply section 12 are provided an ink bottle 65, an ink supply pipe 66 and an ink opening/closing valve 67. When the control section 13 opens the ink opening/closing valve 67, an ink 61 of a predetermined color stored in the ink bottle 65 is supplied to the ink supply system 1.

Moreover, this ink bottle 65 may be substituted by, e.g., a flexible ink container.

It is to be noted that the ink supply section 12 may supply the ink from, e.g., an ink tank or the like storing the ink 61 of the predetermined color to the ink supply system 1 through an ink supply pump or the like.

As shown in FIGS. 3 and 4, a first liquid level detecting section 6 is provided to the reservoir tank 2 of the ink supply system 1, and a first atmospheric opening valve 5 and a first path 7 are provided above the same. One end of the first path 7 is inserted into the reservoir tank 2 from above and communicates with a position below a liquid level detected by the first liquid level detecting section 6.

The first atmospheric opening valve 5 is constituted of, e.g., an electromagnetic valve. The first liquid level detecting section 6 is formed of, e.g., a float switch, an optical sensor or an electrostatic capacitance sensor. The first path 7 is constituted of a general pipe for ink.

Figure 2:
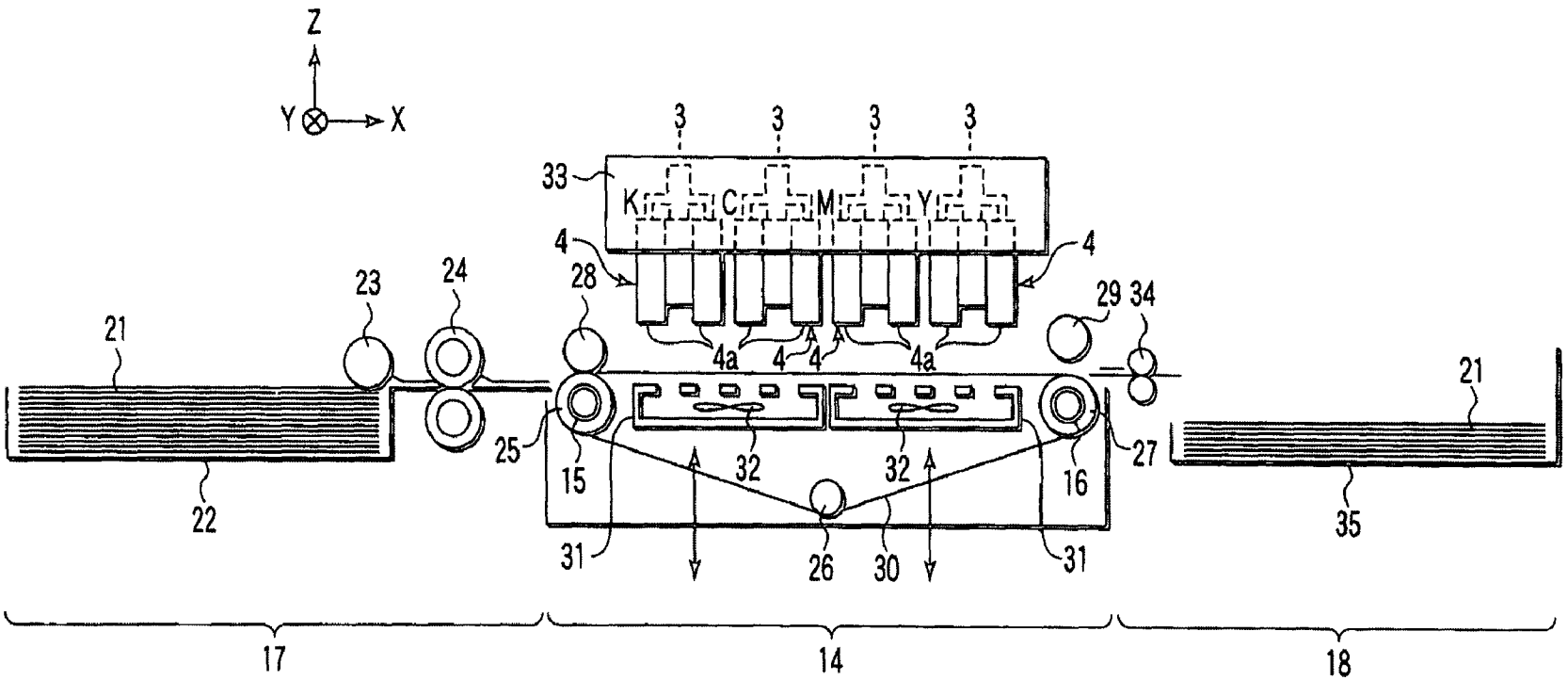
FIG. 2 is an arrangement plan of the image recording apparatus excluding an ink supply section, a control section and a part of the ink supply system.

As shown in FIG. 2 and FIG. 3, each ink chamber 3 of the ink supply system 1 is arranged with a length which is not smaller than at least a width of the recording medium 21 in a direction of a Y axis (which is substantially perpendicular to the carriage direction of the recording medium), and the number of the ink chambers 3 is the same as the number of the recording head groups 4. The ink chamber 3 is provided at least above the recording head group. Additionally, the ink chamber 3 has, on both sides of the carriage direction of the recording medium 21, a head attachment section 44 which holds the plurality of recording heads in a direction substantially vertical to the carried surface of the recording medium 21. It is to be noted that this head attachment section 44 is integrally or separately provided to the ink chamber 3.

Further, as shown in FIGS. 3 and 4, a second liquid level detecting section 9 is provided to the ink chamber 3, a second atmospheric opening valve 8 is provided above the ink chamber 3, and the other end of the first path 7 is inserted into the same. The other end of the first path 7 communicates with the ink chamber 3 to be put into the ink 61 of a predetermined color whose liquid level is set by the second liquid level detecting section 9.

The second atmospheric opening valve 8 is constituted of, e.g., an electromagnetic valve. The second liquid level detecting section 9 is formed of, e.g., a float switch, an optical sensor, or an electrostatic capacitance sensor. In initial filling of the reservoir tank 2 and the ink chamber 3 with the ink, when the control section 13 opens the first atmospheric opening valve 5 and the ink opening/closing valve 67, the ink 61 of the predetermined color is supplied into the reservoir tank 2 from the ink supply section 12. When the supplied ink 61 is fed to reach a liquid level height position in the reservoir tank 2 by the first liquid level detecting section 6, the control section 13 closes the first atmospheric opening valve 5.

Then, the control section 13 opens the second atmospheric opening valve 8. Then, the ink 61 of the predetermined color supplied from the ink supply section 12 and stored in the reservoir tank 2 is fed into the ink chamber 3 through the first path 7. When the ink 61 is supplied to reach a predetermined liquid level height position in the ink chamber 3 by the second liquid level detecting section 9, the control section 13 closes the ink opening/closing valve 67 and the second atmospheric opening valve 8 to stop supply of the ink 61. Initial filling of the reservoir tank 2 and the ink chamber 3 with the ink is carried out in this manner. At this time, the supplied ink 61 of the predetermined color is supplied into the plurality of ink nozzles of the plurality of recording heads 4-1 to 4-4 through a head-side ink supply openings 43 provided at below the ink chamber 3 and upper parts of the recording heads 4-1 to 4-4 in the recording head group 4, a ink supply openings 41 whose number is equal to that of the head-side ink supply openings 43, and a connection paths 42. It is to be noted that the head-side ink supply opening 43 is provided at a substantially central part of the nozzle line of each of the recording heads 4-1 to 4-4. These recording heads 4-1 to 4-4 suggest the nozzle lines (each of which records one line with respect to the recording medium 21) formed with a length which is not smaller than the width of the recording medium 21.

Figure 5:
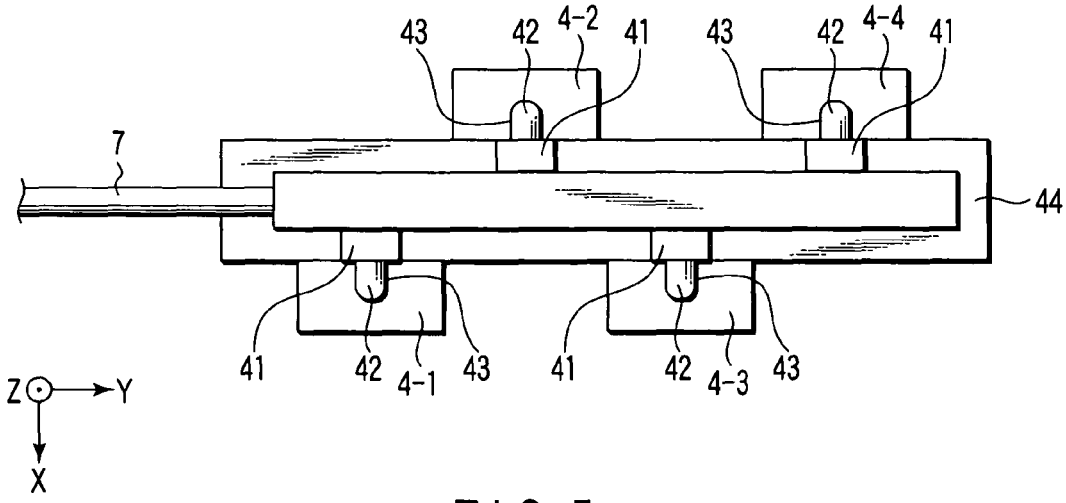
FIG. 5 is a top view showing the first embodiment of the ink supply system according to the present invention.
Figure 6:
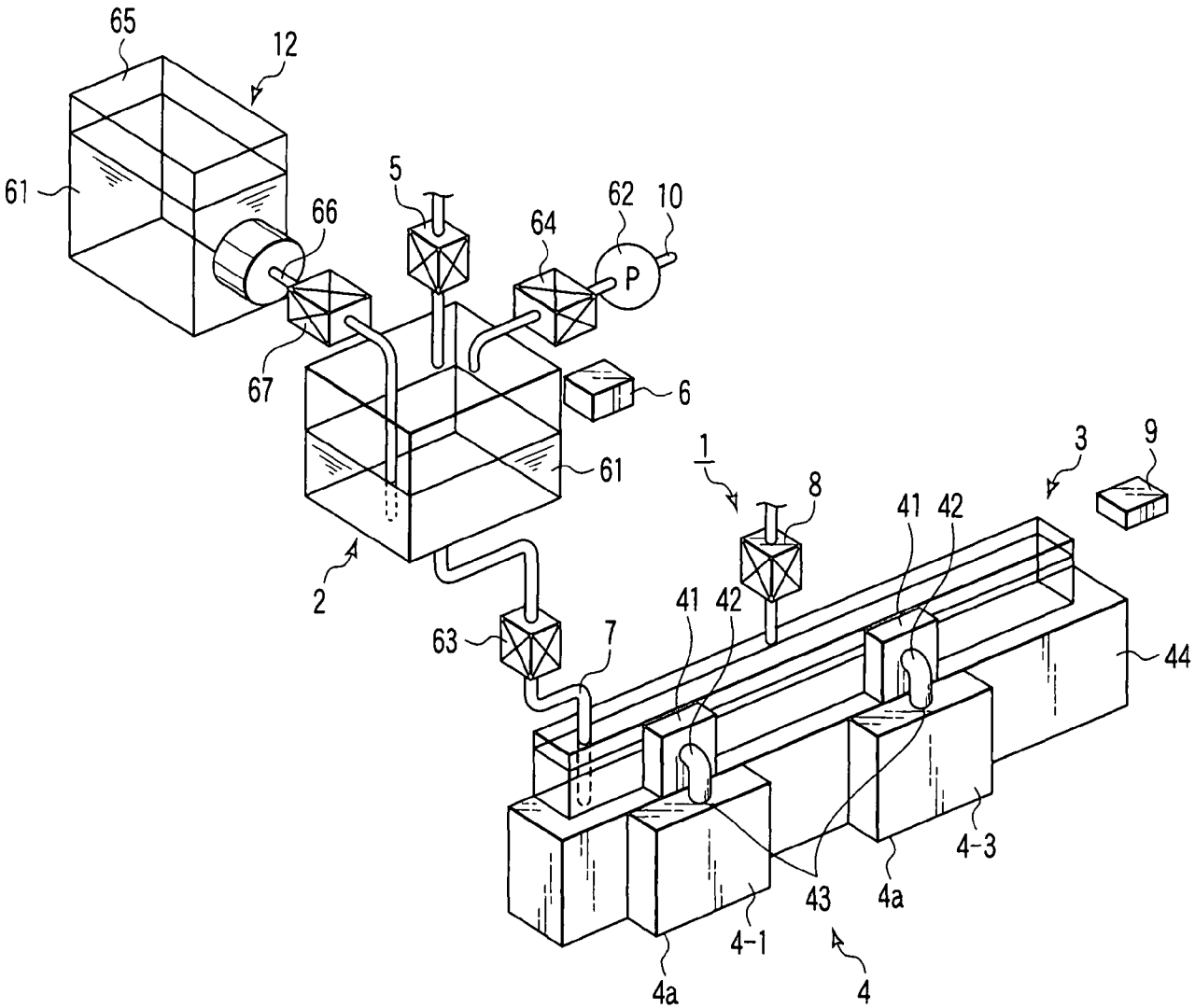
FIG. 6 is a perspective view showing a second embodiment of the ink supply system according to the present invention.
Figure 7:
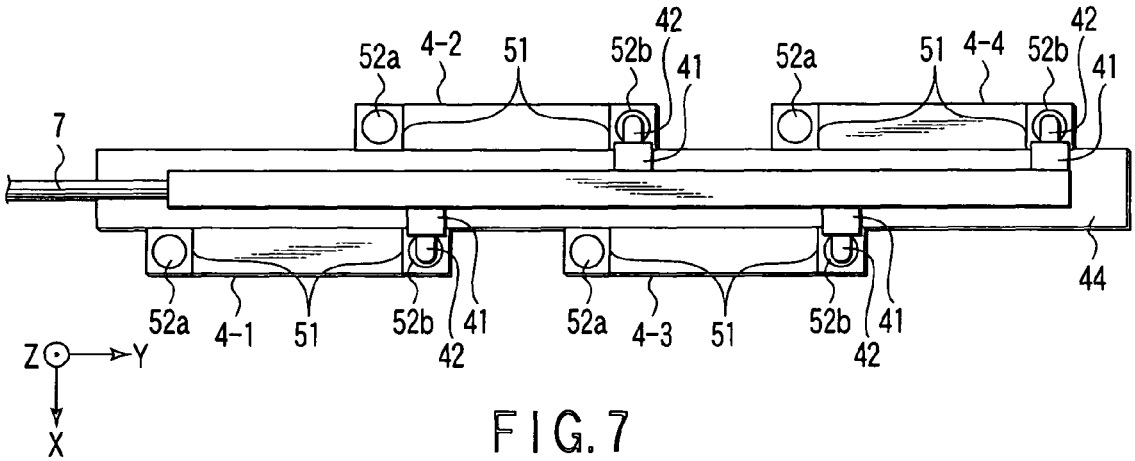
FIG. 7 is a top view showing a first modification of the first and second embodiments of the ink supply system according to the present invention.
Figure 8:
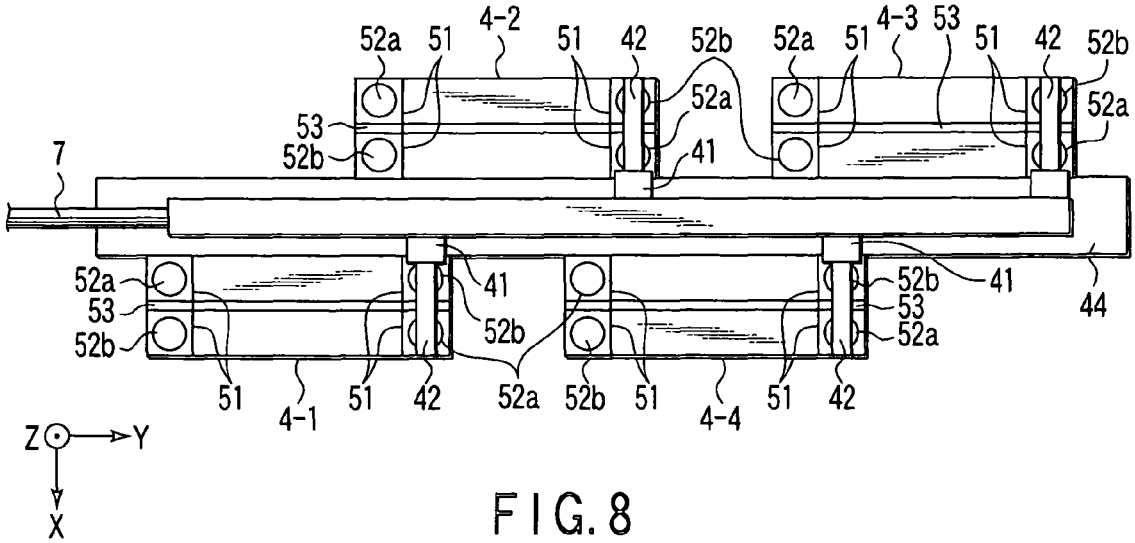
FIG. 8 is a top view showing a second modification of the first and second embodiments of the ink supply system according to the present invention.
Figure 9:
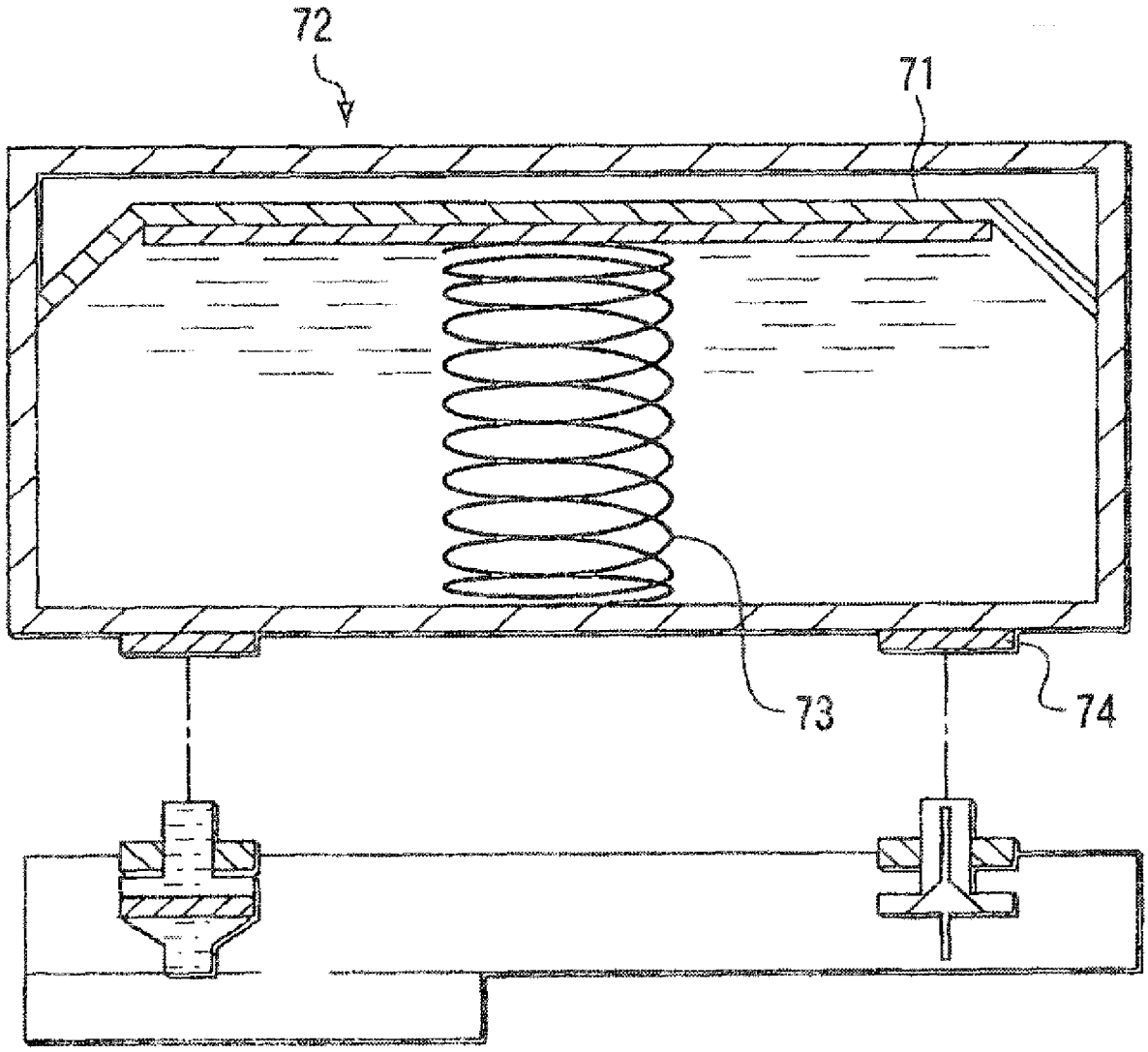
FIG. 9 is a view showing an ink supply path provided in a conventional recording apparatus.

Therefore, FIGS. 3 to 5 and later-explained FIGS. 6 to 8 are shown in a case where n=4 is achieved in the plurality of recording heads 4-1 to **4-*n***.

In the ink chamber 3, the recording heads 4-1 to 4-4 are alternately arranged at lengthwise positions in the carriage direction of the recording medium 21, and the ink supply openings 41 are provided on both sides with a central line between the alternately arranged plurality of recording heads at the center in the vicinity of the arranged recording heads 4-1 to 4-4. The number of the ink supply openings 41 is the same as that of the recording heads.

It is to be noted that the vicinity of the recording heads 4-1 to 4-4 suggests a gap or a position immediately above this gap between the plurality of recording heads 4-1 to 4-4 when they are alternately arranged at the lengthwise positions in the carriage direction of the recording medium 21, for example.

Furthermore, in the ink chamber 3, the ink supply openings 41 are alternately arranged above the arranged recording heads 4-1 to 4-4 in accordance with the arrangement positions of the alternately arranged recording heads 4-1 to 4-4.

Further, in the ink chamber 3, each ink supply opening 41 is arranged at a substantially central position of the nozzle line of the plurality of ink nozzles of each recording head above the arranged recording heads 4-1 to 4-4.

The ink supply openings 41 are connected with the head-side ink supply openings 43 through the connection paths 42 whose number is equal to that of the recording heads. These connection paths 42 have the same length.

Here, as shown in FIG. 4, positions of the nozzle forming surfaces **4*a* forming the plurality of ink nozzles of the recording heads 4-1 to 4-4 are set above a predetermined liquid level height position set by the first liquid level detecting section 6 by a distance h in the reservoir tank 2**.

That is, the ink 61 of the predetermined color supplied from the ink supply section 12 through the reservoir tank 2 is stored in the plurality of ink nozzles of the recording heads 4-1 to 4-4 without leaking from the ink nozzles. Furthermore, this ink 61 is stored at the predetermined liquid level height position by the second liquid level detecting section 9 in the ink chamber 3. Moreover, when the ink 61 of the predetermined color in the reservoir tank 2 and the ink chamber 3 reaches the predetermined liquid level height positions by the first liquid level detecting section 6 and the second liquid level detecting section 9, the control section 13 closes the second atmospheric opening valve 8 so that a predetermined negative pressure acts on the ink 61 of the predetermined color in the ink nozzles by a difference of elevation based on the ink liquid level with the distance h.

This predetermined negative pressure state is a so-called water head pressure, and it is generally a mandatory requirement which allows the recording heads to stably discharge ink in the recording heads whose respective ink nozzles are controlled by a piezoelectric element.

As a result, the control section 13 can perform ink discharge control in image recording with respect to the ink 61 of the predetermined color in the plurality of ink nozzles of the recording heads 4-1 to 4-4 in a state where the predetermined water head pressure constantly acts, thereby stably recording an image.

It is to be noted that, in recording an image, the first atmospheric opening valve 5 is opened. That is, when the control section 13 controls opening/closing operations of the ink opening/closing valve 67, the ink liquid level in the reservoir tank 2 can be maintained at a predetermined height, and this liquid level can be maintained in a state where the predetermined water head pressure acts on the ink 61 in the ink nozzles.

As described above, according to the first embodiment of the ink supply system of the present invention, the reservoir tank 2 which stores the ink 61 of the predetermined color at a position (an ink liquid level) which is below the positions of the nozzle forming surfaces 4*a* of the recording heads 4-1 to 4-4 by the distance h is communicated with the ink chamber 3 provided above the recording heads through the first path 7. As a result, this embodiment can readily set and maintain the water head pressure with respect to the ink 61 in the ink nozzles of the recording heads 4-1 to 4-4.

Moreover, in the ink chamber 3, the recording heads 4-1 to 4-4 are alternately arranged at the lengthwise positions in the carriage direction of the recording medium 21, and the ink supply openings 41 are arranged on both sides with the central line between the alternately arranged recording heads 4-1 to 4-4 at the center in the vicinity of the arranged recording heads 4-1 to 4-4. Therefore, the ink chamber 3 can uniform a pressure loss in the ink supply paths leading to the recording heads 4-1 to 4-4.

A second embodiment of a ink supply system 1 according to the present invention will now be described with reference to FIGS. 1 and 6.

The second embodiment of the ink supply system 1 is different from the first embodiment in that a predetermined liquid level height position in a reservoir tank 2 set by a first liquid level detecting section 6 is above positions of a nozzle forming surfaces 4*a* of a recording heads 4-1 to 4-4 as shown in FIG. 6, whereas the positions of the nozzle forming surfaces 4*a* of the recording heads 4-1 to 4-4 are set above the predetermined liquid level height position in the reservoir tank 2 set by the first liquid level detecting section 6 by the distance h in the first embodiment.

Moreover, another difference from the first embodiment lies in that the reservoir tank 2 is provided above an ink chamber 3. Therefore, one end of a first path 7 is put into the reservoir tank 2. Additionally, the other end of the same is put into ink stored in the ink chamber 3 like the foregoing embodiment. The reservoir tank 2 communicates with the ink chamber 3 through the first path 7.

Further, still another difference from the first embodiment lies in that one end of a second path 10 communicates with the reservoir tank 2 at a position above the predetermined liquid level height position set by the first liquid level detecting section 6, and a negative pressure generation pump 62 is connected with the other end of the second path 10 through a negative pressure opening/closing valve 64.

Yet another difference from the first embodiment lies in that an ink opening/closing valve 63 is provided to the first path 7 communicating with the ink chamber 3.

An ink 61 of a predetermined color in an ink supply section 12 is supplied to the reservoir tank 2 when a first atmospheric opening valve 5 and an ink opening/closing valve 67 are controlled to be opened by a control section 13 like the first embodiment.

Moreover, when the ink 61 of the predetermined color in the reservoir tank 2 is supplied into a plurality of ink nozzles of the recording heads 4-1 to 4-4 and the ink chamber 3, the control section 13 opens the first atmospheric opening valve 5, the ink opening/closing valve 63 and a second atmospheric opening valve 8, respectively. The ink 61 is supplied by a gravitational fall. When the ink 61 is supplied to reach a predetermined liquid level height detected by a second liquid level detecting section 9, the control section 13 closes both the second atmospheric opening valve 8 and the ink opening/closing valve 63. The ink is allowed to flow in or blocked off by opening/closing the valves in this manner, thereby adjusting an ink supply amount.

Then, when the ink 61 of the predetermined color in the reservoir tank 2 is at the predetermined liquid level height position detected by the first liquid level detecting section 6, the control section 13 closes both the first atmospheric opening valve 5 and the ink opening/closing valve 67, opens both the ink opening/closing valve 63 and the negative pressure opening/closing valve 64, thereby driving the negative pressure generation pump 62. As a result, a predetermined negative pressure acts on the ink 61 of the predetermined color in the plurality of ink nozzles of the recording heads 4-1 to 4-4. This predetermined negative pressure state corresponds to a setting of the so-called water head pressure described in conjunction with the first embodiment.

When the predetermined negative pressure acts on the ink 61 in the ink nozzles, the control section 13 stops driving the negative pressure generation pump 62 to close the negative pressure opening/closing valve 64. In this manner, according to this embodiment, since the predetermined water head pressure constantly acts on the ink 61 of the predetermined color in the plurality of ink nozzles of the recording heads 4-1 to 4-4 in a recording head group 4, an image can be stably recorded.

It is to be noted that the first atmospheric opening valve 5 is opened during recording an image in the first embodiment, but the first atmospheric opening valve 5 is closed in this embodiment.

As described above, according to this embodiment, when the ink 61 of the predetermined color in the reservoir tank 2 is supplied into the reservoir tank 2 to reach the predetermined liquid level height position detected by the first liquid level detecting section 6, the control section 13 drives the negative pressure generation pump 62 to generate the negative pressure in the second path 10.

The generated negative pressure acts on the ink 61 of the predetermined color in the ink chamber 3 through the communicated reservoir tank 2, the first path 7 and the ink opening/closing valve 63. Therefore, this embodiment can readily set and maintain the predetermined water head pressure with respect to the ink 61 of the predetermined color in the plurality of ink nozzles of the recording heads 4-1 to 4-4.

Additionally, in the ink chamber 3, the recording heads 4-1 to 4-4 are alternately arranged at lengthwise positions in a carriage direction of a recording medium 21. Further, in the ink chamber 3, ink supply openings 41 are provided in both sides in the vicinity of the recoding heads 4-1 to 4-4 with a central line between the alternately arranged recording heads 4-1 to 4-4 at the center. Therefore, this embodiment can uniform a pressure loss of ink supply paths leading to the recording heads 4-1 to 4-4 like the first embodiment.

A description will now be given as to a first modification of the first and second embodiments of a ink supply system according to the present invention.

FIG. 7 shows the first modification of the first and second embodiments.

In the ink chamber 3 according to the first and second embodiments, the head-side ink supply openings 43 are arranged at the substantially central part of the nozzle lines of the recording heads 4-1 to 4-4 in order to connect the head-side ink supply openings 43 with the connection paths 42 above the arranged recording heads 4-1 to 4-4. On the other hand, according to the first modification, a head-side ink supply openings 52*a* and 52*b* are arranged at a both end sections 51 of each of the recording heads 4-1 to 4-4 in a nozzle line direction. The head-side ink supply openings 52*a* and 52*b* are symmetrically arranged with a central position of the nozzle line of each of the recording heads 4-1 to 4-4 at the center, and they can be connected with the connection path 42.

The ink chamber 3 according to this first modification is different from the counterpart according to the foregoing embodiments in that the recording heads 4-1 to 4-4 are alternately arranged at the lengthwise positions in the carriage direction of the recording medium 21 and each ink supply opening 41 is arranged on both sides with the central line between the recording heads 4-1 to 4-4 at the center in accordance with the two head-side ink supply openings 52*a* and 52*b*.

As a result, according to this first modification, each ink supply opening 41 can be selectively connected with one of the head-side ink supply openings 52*a* and 52*b* and used. At this time, the head-side ink supply opening 52*a* or 52*b* which is not used is closed by, e.g., thermofusion.

Further, according to the first embodiment, when the head-side ink supply openings 52*a* and 52*b* are provided in both sides of the both end sections 51 of the recording heads 4-1 to 4-4 along the nozzle line direction, an electrical connecting section for an actuator of each of the recording heads 4-1 to 4-4 can be provided between the head-side ink supply opening 52*a* and the head-side ink supply opening 52*b*, for example.

Furthermore, according to this first modification, since the two head-side ink supply openings 52*a* and 52*b* are provided with respect to one recording head, circulation cleaning of a head ink chamber can be performed by using a cleaning liquid at the time of manufacture of the recording heads. Alternatively, there can be obtained a secondary effect. For example, air bubbles are stored in a head common pressure chamber, and an air damper can be provided for a fluctuation in a pressure in the head common pressure chamber. Moreover, there can be also obtained another secondary effect that this recording head can be likewise applied to an ink supply system constituting a circulation ink path without changing a conformation.

As described above, according to the first modification, in the ink chamber 3, the recording heads 4-1 to 4-4 are alternately arranged at the lengthwise positions in the carriage direction of the recording medium 21, and the ink supply openings 41 are provided in both sides in the vicinity of the recording heads 4-1 to 4-4 with the central line between the alternately arranged recording heads 4-1 to 4-1 at the center. Therefore, this modification has specific characteristics obtained by providing the head-side ink supply openings 52*a* and 52*b* on both sides of the both end sections 51 of each of the recording heads 4-1 to 4-4 in the nozzle line direction in addition to the effect of uniforming a pressure loss of the ink supply paths leading to the recording heads 4-1 to 4-4.

A description will now be given as to a second modification of the first and second embodiments of a ink supply system according to the present invention.

FIG. 8 shows a second modification of the first and second embodiments.

The second modification is the same as the first modification in that a head-side ink supply openings 52*a* and 52*b* are symmetrically arranged in a both end sections 51 of each of a recording heads 4-1 to 4-4 in a nozzle line direction with a central position of the nozzle line of each recording head at the center, and these openings can be connected with each connection path 42.

Additionally, an ink chamber 3 according to this second modification is the same as the counterpart according to the first modification in that the recording heads 4-1 to 4-4 in a recording head group 4 are alternately provided at lengthwise positions in a carriage direction of a recording medium 21, and that each ink supply opening 41 is provided in accordance with the two head-side ink supply openings 52*a* and 52*b* at the positions of the both end sections 51 in the nozzle line direction when providing the respective ink supply openings 41 on both sides in the vicinity of the recording heads 4-1 to 4-4 with a central line between the alternately arranged recording heads 4-1 to 4-4 at the center.

This second modification is different from the first modification in that a joint recording heads obtained by jointing a plurality of recording heads are arranged as the recording heads 4-1 to 4-4 which are alternately arranged at the lengthwise positions in the carriage direction of the recording medium 21 in the ink chamber 3 according to the first modification. In the joint recording heads, nozzles are shifted from each other in the nozzle line direction with a half of a nozzle pitch.

The joint recording heads are jointed and arranged back to back through a base plate 53, thereby doubling a resolving power.

Therefore, this second modification is the same as the first modification except that each head-side ink supply opening 52*b* is adjacent to each head-side ink supply opening 52*a* by joint and each connection path 42 is connected with these openings.

As described above, according to the second modification, in addition to the same effect as that of the first modification, the present invention can be likewise applied to the joint recording heads in order to improve a resolving power.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An ink supply system to which an ink of a predetermined color is supplied from an ink supply section, comprising:

a recording head group in which there are provided a plurality of recording heads each including a plurality of ink nozzles through which the ink of the predetermined color is discharged to a recording medium to be carried;

a reservoir tank which stores the ink of the predetermined color supplied from the ink supply section; and an ink chamber which distributes and supplies the ink of the predetermined color, which is fed from the reservoir tank, to the recording heads provided in the recording head group;

wherein an inside of the ink chamber is maintained in a predetermined negative pressure state;

wherein a plurality of ink supply openings are provided in the ink chamber, a number of the ink supply openings being equal to at least a number of the recording heads; and wherein a plurality of respective connection paths which are connected from the plurality of ink supply openings to a plurality of head-side ink supply openings each have substantially a same length, a number of the respective connection paths being equal to at least the number of the recording heads.

2. The ink supply system according to claim 1, wherein the predetermined negative pressure in the ink chamber is generated by:

the reservoir tank which stores the ink supplied from the ink supply section, and is arranged in such a manner that an ink liquid level of the stored ink is positioned below the ink nozzles by a predetermined distance; and a first path having one end being put in the ink in the reservoir tank and the other end being put in and communicated with the ink stored in the ink chamber, wherein the predetermined negative pressure acts on the ink in the ink nozzles through the inside of the ink chamber.

3. The ink supply system according to claim 2, wherein the reservoir tank supplies the ink to the ink chamber through the first path.

4. The ink supply system according to claim 1, wherein the predetermined negative pressure in the ink chamber is generated by:

a negative pressure generation pump connected with a second path communicating with an upper part of the reservoir tank; and a first path having one end being put in the ink in the reservoir tank and the other end being put in the ink stored in the ink chamber, and the predetermined pressure acts on the ink in the ink nozzles through the ink chamber.

5. The ink supply system according to claim 4, wherein the reservoir tank supplies the ink to the ink chamber through the first path.

6. The ink supply system according to claim 4, wherein an ink opening/closing valve which controls the ink supplied to the ink chamber from the reservoir tank is provided in the first path.

7. The ink supply system according to claim 1, wherein the reservoir tank includes a first liquid level detecting section which detects a liquid level of the ink stored in the reservoir tank.

8. The ink supply system according to claim 1, wherein the reservoir tank includes a first atmospheric opening valve at an upper part thereof.

9. The ink supply system according to claim 1, wherein the ink supply system is provided with a plurality of the ink chambers and a plurality of the recording head groups, and wherein a number of the ink chambers is equal to at least a number of the recording head groups.

10. The ink supply system according to claim 1, wherein each of the head-side ink supply openings is arranged at a position corresponding to an end position of a nozzle line comprising the ink nozzles.

11. The ink supply system according to claim 1, wherein each of the head-side ink supply openings is arranged at a position corresponding to a substantially central position of a nozzle line comprising the ink nozzles.

12. The ink supply system according to claim 1, wherein the ink chamber is provided in a same direction as an arrangement direction of the recording head group, which arrangement direction is substantially perpendicular to a carriage direction of the recording medium.

13. The ink supply system according to claim 1, wherein the ink chamber is provided above the recording head group.

14. The ink supply system according to claim 1, wherein the ink chamber includes a head attachment section which holds each of the plurality of recording heads in a direction substantially vertical to a carried surface of the recording medium.

15. The ink supply system according to claim 14, wherein the head attachment section is one of integrally provided to the ink chamber, and separately provided to the ink chamber.

16. The ink supply system according to claim 1, wherein the ink chamber includes a second atmospheric opening valve at an upper part thereof.

17. The ink supply system according to claim 1, wherein the ink chamber includes a second liquid level detecting section which detects a liquid level of the ink stored in the ink chamber.

* * * * *